US006918193B2

(12) United States Patent
Marolt

(10) Patent No.: US 6,918,193 B2
(45) Date of Patent: Jul. 19, 2005

(54) SHOE DRIER

(76) Inventor: Oswald Marolt, Untervocken 15, A-9821 Obervellach (AT)

( * ) Notice: Subject to any disclaimer, the term of this patent is extended or adjusted under 35 U.S.C. 154(b) by 2 days.

(21) Appl. No.: 10/452,656

(22) Filed: Jun. 3, 2003

(65) Prior Publication Data

US 2004/0064963 A1 Apr. 8, 2004

(30) Foreign Application Priority Data

Jun. 3, 2002 (AT) ..... GM351/2002

(51) Int. Cl.[7] ..... F26B 25/00
(52) U.S. Cl. ..... 34/104; 34/90; 34/239
(58) Field of Search ..... 34/239, 90, 103, 34/104

(56) References Cited

U.S. PATENT DOCUMENTS

| | | | | |
|---|---|---|---|---|
| 3,417,482 A | | 12/1968 | Peet | |
| 3,513,564 A | * | 5/1970 | Gramprie | 34/104 |
| 3,645,009 A | * | 2/1972 | Ketchum | 34/104 |
| 4,768,293 A | * | 9/1988 | Kaffka | 34/104 |
| 5,199,188 A | * | 4/1993 | Franz | 34/105 |
| 5,222,308 A | * | 6/1993 | Barker et al. | 34/104 |
| 5,412,928 A | * | 5/1995 | Reithel | 34/104 |
| 6,327,792 B1 | * | 12/2001 | Hebert | 34/104 |
| 6,698,106 B1 | * | 3/2004 | Reithel et al. | 34/443 |

FOREIGN PATENT DOCUMENTS

| | | |
|---|---|---|
| AT | 388 094 B | 4/1989 |
| AT | 397 910 B | 8/1994 |
| AT | 401 720 B | 11/1996 |
| FR | 2 544 190 | 10/1984 |
| FR | 2 658 409 | 8/1991 |
| WO | 88/06423 | 9/1988 |

* cited by examiner

*Primary Examiner*—Denise L. Esquivel
*Assistant Examiner*—Kathryn S. O'Malley
(74) *Attorney, Agent, or Firm*—Young & Thompson

(57) ABSTRACT

A shoe drier has a housing from which paired tubes (10) project as holding elements for the shoes, boots, or the like which are to be dried. In the housing (1) there is a fan (15) which forces air into the tubes (10), the tubes are chosen to be serpentine and project with their free ends out of the housing. The air which has been forced into the tubes emerges from the tubes (10) through openings (20). In order to heat the air (19) emerging from the openings (20), there are heat conductors (30) in the tubes (10).

12 Claims, 3 Drawing Sheets

SHOE DRIER

BACKGROUND OF THE INVENTION

Description of the Related Art

The invention relates to a shoe drier with a housing, from which tubular holders for the shoes project, from which holders heated air enters the shoes.

These shoe driers are known in the most varied embodiments. For example, reference is made to AT 388 094 B in which on the housing there are holding bows bent into a U shape for shoes, to which heated air is delivered via a fan located in the housing. The air emerges from the bow-shaped holders through an opening provided in the area of the bent section thereof and enters the shoe in order to dry it.

A similar design is shown by FR 2 658 409 A in which on the holding part there are several bows located next to one another and onto which the boots or the like which are to be dried can be slipped. Here the tubes which are bent into a U shape and onto which the shoes are to be slipped, are made as heatable tubes without air being routed through them. As heating possibilities FR 2 658 409 A mentioned a heating medium (water or oil) which flows through the tubes or an electrical heating cable.

AT 401 720 B describes a device for drying of shoes in which the shoes can be slipped onto holding elements which are formed by the tubes bent into projecting curves. The tubes house electrical resistance heating cable. In the curves there are air exit openings through which air heated within the tubes can emerge upward on each curve. There is no fan in the device for drying shoes as claimed in AT 401 7201 B.

In the known shoe-drying devices the problem is that the air emerging from the holding elements, if such an air flow is induced by a fan is unfavorable because laminar flow occurs which hinders the drying process.

SUMMARY OF THE INVENTION

The object of the invention is to devise a shoe drier of the initially mentioned type which does not have the described disadvantages and has a simple structure.

Since in the device as claimed in the invention for drying shoes in the area of the holding elements made as rods bent into a serpentine line for the shoes there are several air exit openings, in the interior of the shoe which has been slipped onto the holding element a turbulent flow arises which advantageously supports the drying process.

In the invention it can be provided that the tubes are supplied by a fan with air heated outside the tubes. Alternatively it can be provided that the air supplied to the tubes by a fan is not preheated, but is heated only in the tubes themselves by the heating conductors located there. The latter embodiment is especially favorable since the loss of heat output which would occur in heating located outside the holding elements made as tubes is kept low if not entirely prevented.

Other details and features of the invention result from the following description of one preferred embodiment using the drawings.

DESCRIPTION OF THE PREFERRED EMBODIMENTS

Figure 1:
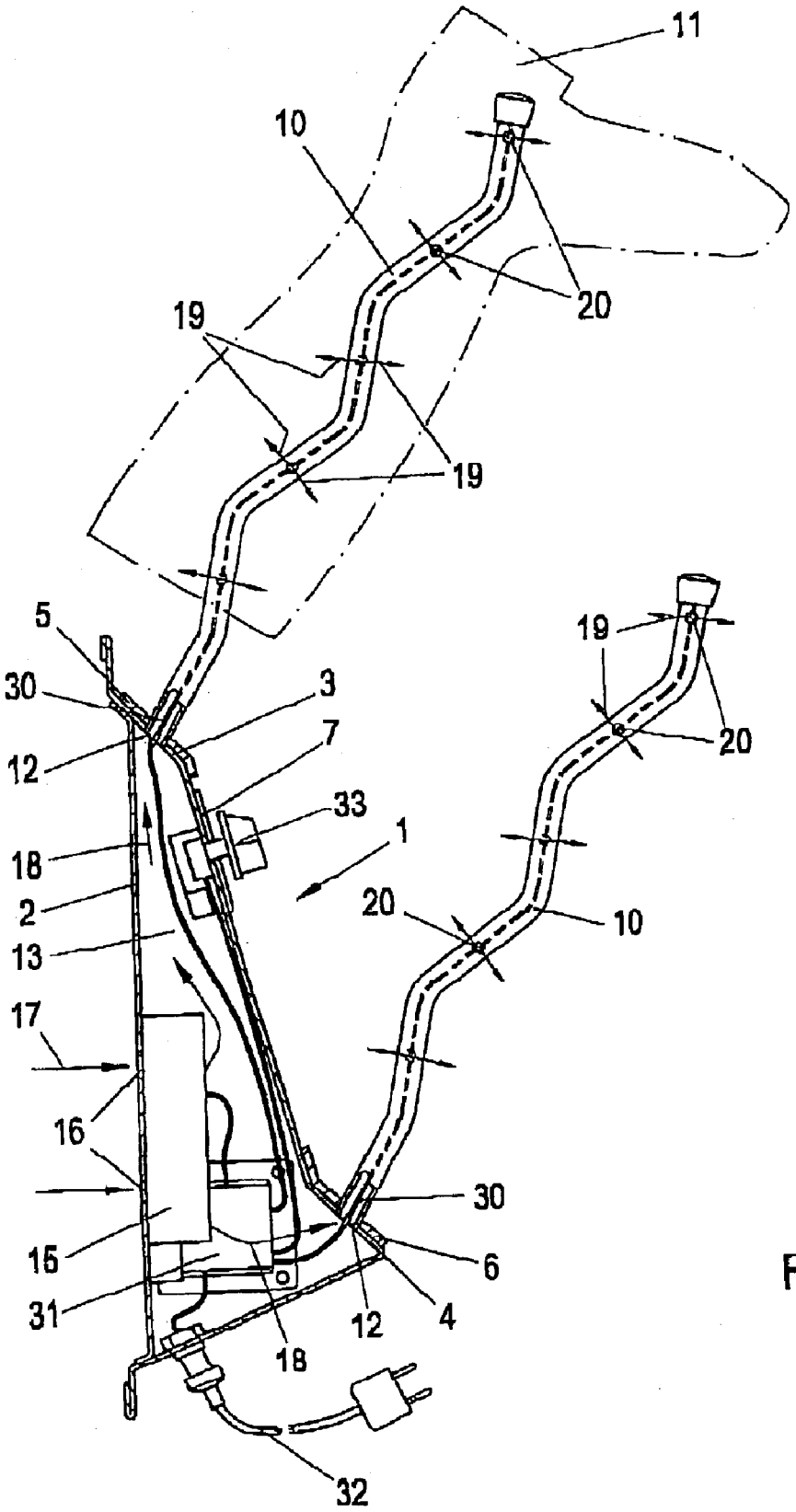
FIG. 1 shows one embodiment of a device as claimed in the invention for drying shoes in a section, for the most part schematic.
Figure 2:
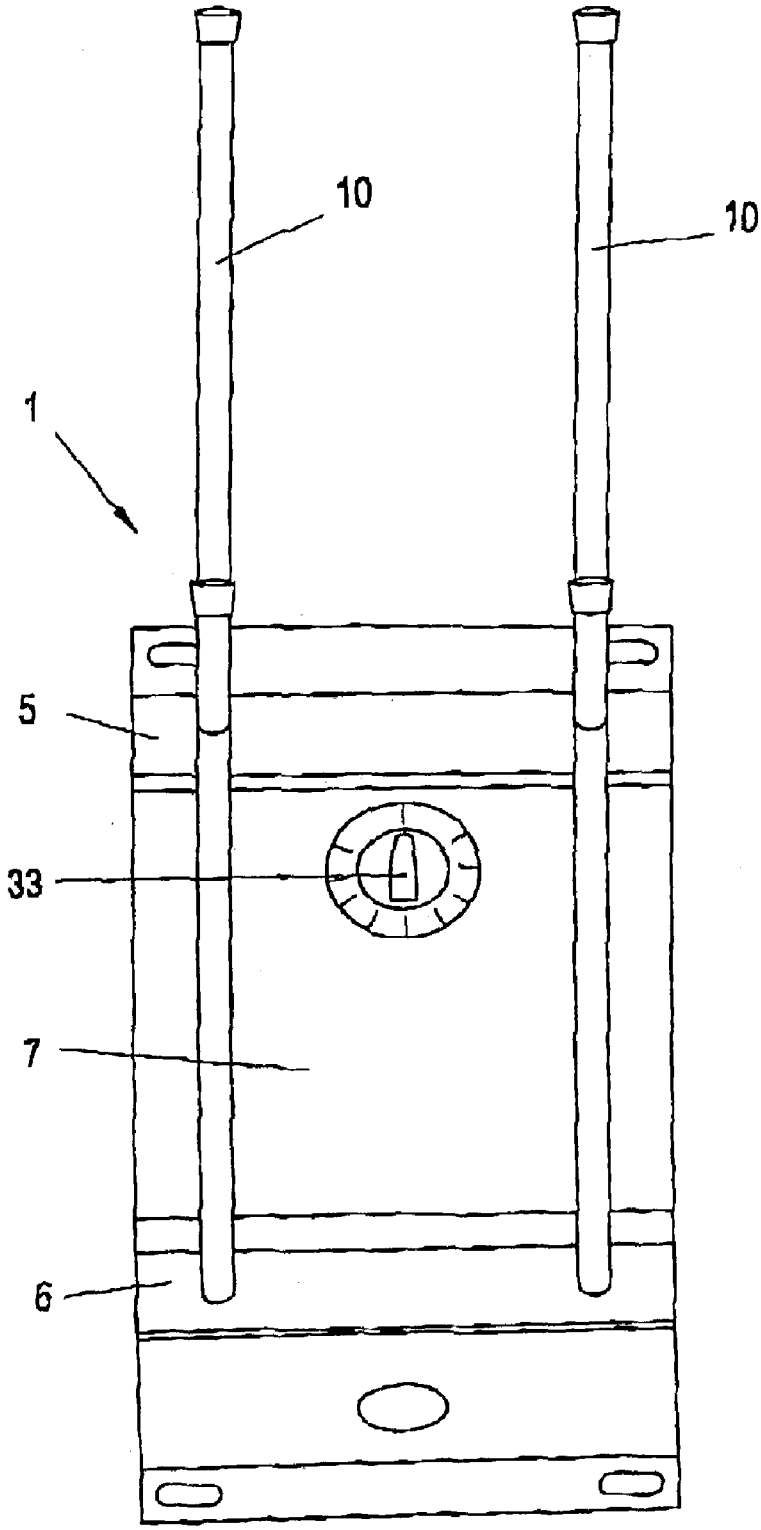
FIG. 2 shows the device viewed from forward and FIG. 3 shows the device for drying of shoes in an oblique view from the top front.
Figure 3:
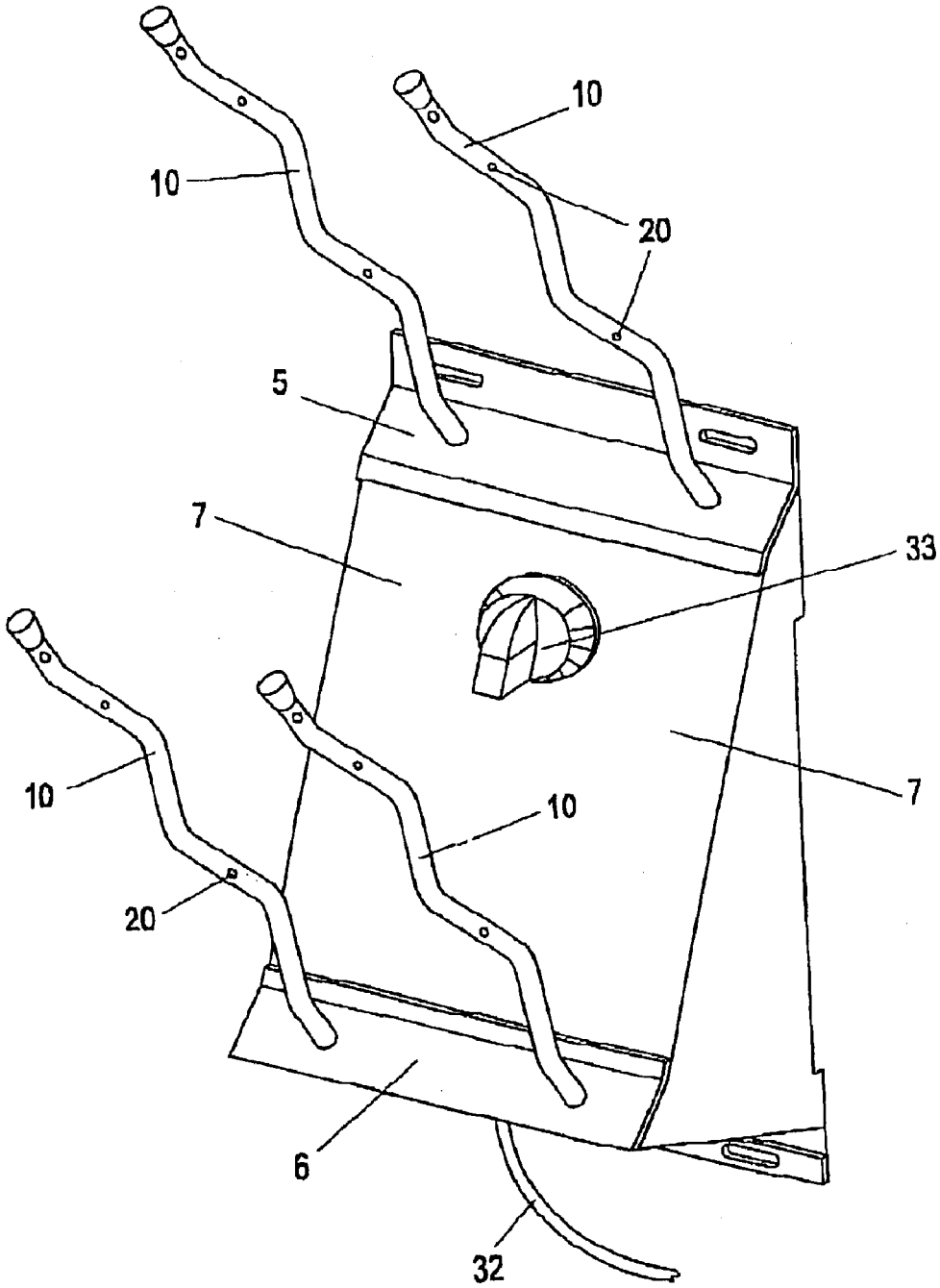

The device for drying shoes as claimed in the invention and shown in FIGS. 1 and 2 has a housing 1 which is made for example from sheet metal and which for example has a wedge-shaped cross section which tapers from bottom to top, when it is viewed from the side. The housing has a removable rear wall 2.

From the two flat areas 3, 4 of the front 7 of the housing 1 which are reinforced by supports 5, 6, there project two paired tubes 10 bent into a serpentine line as holding elements for the shoes 11 which are to be dried. The interior of each tube 10 is connected via an opening 12 to the interior 13 of the housing.

In this way, air 18 is forced into the tubes 10 by the fan 115 which is mounted for example on the removable back wall 2 of the housing 1 and which intakes air 17 through the openings 16 located in it and forces the air into the interior 13 of the housing 11, and emerges through the openings 20 in the tubes 10 from the openings and enters a slipped-on shoe 11 as is symbolized schematically in FIG. 1 using a boot so that it is dried.

Because the tubes 10 are corrugated and especially because the exit openings 20 are arranged distributed over the length of the tubes 10, within the shoe 11 (in the example a boot) a turbulent flow arises and advantageously supports the drying process. It is also advantageous that the openings 20 are located on either side of the tubes 10, that air emerges from the openings 20 transversely to the plane which is vertical in the position of use and in which the corrugations of the tubes 10 lie. Aside from the (equiaxial) openings 20 which are located opposite one another, in the area of the free ends of the tubes 10 the remaining openings 20 in the tubes 10 are preferably not opposite one another.

In order to heat the air 19 which emerges from the tubes 10, there can either be a heating device in the housing 1, or as shown in the embodiment and as is preferably within the framework of the invention, in the interior of the tubes 10 which are used as holding elements for shoes, boots, etc, there are heat conductors 30 which are supplied with current via a transformer 31 which is accommodated in the housing 1. The transformer 31 and thus the heating conductor 30 as well as the fan 15 which is likewise connected to the transformer 31 are connected via a lead 32 to an external power source. On the housing 1 there can also be a switch 33, preferably a timer, in order to turn the shoe drier on/off.

Even if in the illustrated embodiment there are two pairs of tubes 10 on top of one another as the holding device for the shoes, the invention is not limited to two pairs of tubes 10. Thus there can be embodiments with only one pair of tubes 10 and embodiments with more than two pairs of tubes 10 as holding devices for shoes and the like, depending on how many shoes are to be dried at one time.

In summary, one embodiment of the invention can be described as follows.

A shoe drier has a housing from which paired tubes 10 project as holding elements for the shoes, boots, or the like which are to be dried. In the housing 1 there is a fan 15 which forces air into the tubes 10, the tubes are chosen to be serpentine and project with their free ends out of the housing. The air which has been forced into the tubes emerges from the tubes 10 through openings 20. In order to heat the air 19 emerging from the openings 20, there are heat conductors 30 in the tubes 10.

What is claimed is:

1. A dryer, comprising:

a housing (1);

a fan mounted within the housing;

plural tubular holding elements (10) in air connection with the housing, each holding element suitable for insertion into a shoe project; and at least one air exit opening (20) in each holding element that exhausts air forced from the fan into the holding element, each holding element comprising plural connected sections of tubing, the plural sections being commonly aligned in a single plane and forming a corrugated single-plane serpentine line, the plural sections including a first section connected to the housing, a terminal end section and plural sections intermediate the first and terminal end sections, the sections aligned lengthwise in the single plane.

2. The dryer of claim 1, wherein, the plane is vertical in a position in which the device is used.

3. The dryer of claim 2, wherein the exit openings (20) are aligned transversely to the plane.

4. The dryer of claim 1, wherein the housing has an overall wedge shaped cross section tapering from a base part to a top part, when in a position of use and viewed from a side.

5. The dryer of claim 4, wherein plural holding elements comprise a first lower holding element located adjacent the base part and a second upper holding element located adjacent the top part.

6. The dryer of claim 5, wherein, the housing is made of sheet metal and includes a vertical back wall, and the fan is mounted to the back wall.

7. The dryer of claim 6, wherein the first and second holding elements are mounted to the housing opposite the back wall.

8. The dryer of claim 7, wherein, the plane is vertical in the position in which the device is used, the exit openings (20) are equiaxial openings aligned transversely to the plane.

9. The dryer of claim 8, further comprising:

at least one heater that heats the air being forced into the holding elements.

10. The dryer of claim 9, wherein a heater is located within each holding element.

11. The dryer of claim 9, further comprising a timer operatively connected to at least one heater.

12. A shoe dryer, comprising:

a housing (1) with a vertically oriented major dimension;

plural tubular holding elements (10) connected to the housing, each holding element suitable for insertion into a shoe project and in air-connection with air from the housing;

a fan forcing air into the holding elements; and plural air exit openings (20) in each holding element, the openings exhausting the air forced, by the fan, into the holding element, wherein, each holding element comprises plural connected sections of tubing, the plural sections being commonly lengthwise aligned in a single plane and forming a corrugated serpentine line, the plural sections including a first section connected to the housing, a terminal end section and plural sections intermediate the first and terminal end sections.

* * * * *